US009150938B2

(12) United States Patent
Oroskar

(10) Patent No.: US 9,150,938 B2
(45) Date of Patent: Oct. 6, 2015

(54) TAGATOSE PRODUCTION FROM DEPROTEINIZED WHEY AND PURIFICATION BY CONTINUOUS CHROMATOGRAPHY

(71) Applicant: OROCHEM TECHNOLOGIES, INC., Naperville, IL (US)

(72) Inventor: Anil R. Oroskar, Oak Brook, IL (US)

(73) Assignee: OROCHEM TECHNOLOGIES, INC., Naperville, IL (US)

( * ) Notice: Subject to any disclaimer, the term of this patent is extended or adjusted under 35 U.S.C. 154(b) by 184 days.

(21) Appl. No.: 13/916,021

(22) Filed: Jun. 12, 2013

(65) Prior Publication Data

US 2014/0366869 A1 Dec. 18, 2014

(51) Int. Cl.
*C13K 13/00* (2006.01)
*C13K 1/00* (2006.01)

(52) U.S. Cl.
CPC .. *C13K 13/00* (2013.01); *C13K 1/00* (2013.01)

(58) Field of Classification Search
None
See application file for complete search history.

(56) References Cited

U.S. PATENT DOCUMENTS

| | | | | |
|---|---|---|---|---|
| 2,985,589 | A | 5/1961 | Broughton | |
| 4,067,748 | A * | 1/1978 | Rowe | 127/36 |
| 4,359,430 | A | 11/1982 | Heikkila | |
| 4,412,866 | A | 11/1983 | Schoenrock | |
| 5,078,796 | A * | 1/1992 | Beadle et al. | 127/46.1 |
| 5,466,294 | A | 11/1995 | Kearney | |
| 5,538,637 | A | 7/1996 | Hester | |
| 5,547,817 | A | 8/1996 | Okada | |
| 5,968,362 | A | 10/1999 | Russo | |
| 6,057,135 | A | 5/2000 | Ibrahim | |
| 6,391,204 | B1 | 5/2002 | Russo | |
| 2002/0169344 | A1 * | 11/2002 | Elliott | 568/863 |
| 2008/0041366 | A1 | 2/2008 | Wahnon | |
| 2009/0056707 | A1 | 3/2009 | Foody | |
| 2011/0245491 | A1 * | 10/2011 | Airaksinen et al. | 536/128 |

FOREIGN PATENT DOCUMENTS

WO WO/2011/150556 * 12/2011

OTHER PUBLICATIONS

Fredrick J. Bates & Associates, "Polarimetry, Saccharimetry and the Sugars", May 1, 1942, pp. 632-636, Circular of the National Bureau of Standards C440, Washington, D.C.

* cited by examiner

*Primary Examiner* — Melvin C Mayes
*Assistant Examiner* — Douglas Call
(74) *Attorney, Agent, or Firm* — Richard P. Silverman & Assoc., LLC

(57) ABSTRACT

Disclosed is a process for the production of d-tagatose from deproteinized whey or whey permeate containing lactose after acid hydrolysis to provide a hydrolysate comprising 1 equivalent of d-glucose and 1 equivalent of d-galactose for each unit of lactose converted. More particularly, the invention relates to a process for the isomerization of d-galactose to d-tagatose and the use of a simplified separation scheme based on simulated moving bed (SMB) separation. The isomerization of d-galactose to d-tagatose is carried out in the presence of calcium oxide or calcium hydroxide. The process is useful for providing a simplified processing route to providing pure d-tagatose and glucose syrup as two products from lactose hydrolysate isomerate. D-tagatose is useful as a food additive, as a sweetener, as a texturizer, as a stabilizer, or as a humectant.

17 Claims, 5 Drawing Sheets

TAGATOSE PRODUCTION FROM DEPROTEINIZED WHEY AND PURIFICATION BY CONTINUOUS CHROMATOGRAPHY

FIELD OF THE INVENTION

This invention is generally concerned with an improved method for the production of high purity d-tagatose and an enriched glucose product from deproteinized whey. More particularly, the invention relates to a process combination of acid hydrolysis of the deproteinized whey, isomerization of the resulting mixture of glucose and galactose, and simulated moving bed separation to simultaneously produce the high purity tagatose and the enriched glucose product.

BACKGROUND

Whey is useful in all of its forms. In some cases whey is processed to directly recover whey protein and leaves behind a material often referred to as deproteinized whey, which refers to the liquid remaining after treatment of whey to remove the majority of the whey protein. The material is not deproteinized completely, but contains most of the insoluble membrane protein fragments from milk fat globular membrane (MFGM) originally present in the whey. When produced by some procedures, the fat content is essentially removed. In others, such as ion exchange chromatography, the fat is not removed and is carried along with the deproteinized whey and contains proteins associated with the fat. This fraction contains most of the insoluble membrane fragments. Deproteinized whey is manufactured through the ultrafiltration of sweet dairy whey, removing a portion of the protein from sweet whey to result in off color viscous fluid containing greater than 80% carbohydrate (lactose) levels. Traditionally lactose is hydrolyzed to equimolar mixture of d-glucose and d-galactose by enzyme lactase or using mineral acids such as dilute hydrochloric acid.

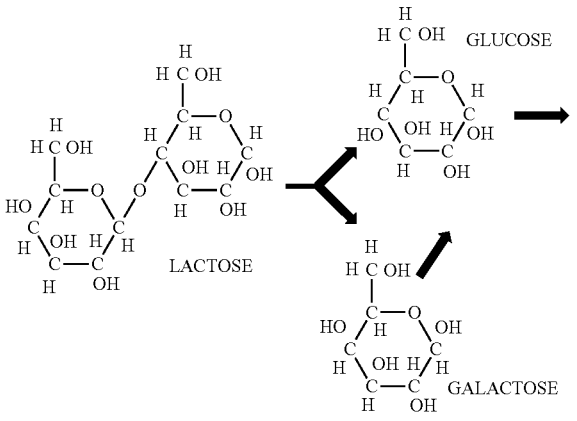

Typical quality of commercially available deproteinized whey has composition shown in Table 1.

TABLE 1

TYPICAL COMMERCIALLY QUALITY DEPROTEINIZED WHEY

| Analysis | Specification | Typical range | Test Method |
|---|---|---|---|
| Moisture (%) | 5.0 max. | 4.7 +/− 0.2 | Karl Fisher |
| Total Protein (%) | 5.5 min. | 7.5 +/− 1.0 | Leco Combustion |
| Fat (%) | 1.5 max. | 0.9 +/− 0.3 | Mojonnier |
| Ash (%) | 11.0 max. | 10.0 +/− 0.4 | Residue on Ignition |
| Lactose (%) | 74.5-81.5 | 77.5 +/− 1.5 | By Difference |
| pH | 5.8-6.5 | 6.1 +/− 0.1 | 10% Sol. @ 20° C. |
| Scorched Particles | 15 mg/25 g max. | 7.5 mg | ADPI |

D-tagatose can be formed from d-galactose by enzymatic isomerization. Typically, the isomerization is carried out in the presence of L-arabinose isomerase under alkaline conditions in the presence of calcium. D-tagatose is useful as a food additive, as a sweetener, as a texturizer, as a stabilizer, or as a humectant. D-tagatose is also useful in formulating dietetic foods with a low glycemic index. Potential applications of d-tagatose include breakfast cereals, diet soft drinks, reduced fat ice cream, hard and soft candies, chewing gums, dietary supplements, and special diet food for meal replacement.

A variety of methods exist for separating polar organic substances from ionic substances. Many of these methods require multiple purification steps and do not achieve complete separation. For example, U.S. Pat. Nos. 5,968,362 and 6,391,204 describe methods involving the use of an anionic exchange resin to remove heavy metals and acid from organic substances. However, these methods are not amenable to complete acid removal, nor do they allow for removal of inorganic and organic cations and anions simultaneously. Similarly, U.S. Pat. Nos. 5,538,637 and 5,547,817 describe methods for separating acids from sugar molecules. However, these methods are limited to separating acids and are not applied to the simultaneous removal of all forms of inorganic and organic cations and anions. Additionally, U.S. Patent Publication Nos. 2009100556707 and 200810041366 disclose using an ion exchange resin for separating first calcium sulfate then acids from sugar mixtures.

D-tagatose is typically produced in a two-step process wherein lactose is enzymatically hydrolyzed to d-Galactose and d-glucose using immobilized lactase. The d-galactose is typically separated using a cation exchange resin. The separated d-galactose is then isomerized to produce d-tagatose under alkaline conditions (typically at a pH of 12) using calcium hydroxide to form a precipitate. The precipitate is subsequently treated with sulfuric acid to free the d-tagatose, and the filtrate is demineralized in a cation and anion exchanger. Typically, the resulting solution is concentrated and purified by chromatic fractionation using a cation exchanger. The d-tagatose is recovered by crystallization.

Simulation of a moving sorbent bed is described in U.S. Pat. No. 2,985,589 (Broughton et al.), which is mentioned above. In accomplishing this simulation, it is necessary to connect a feed stream to a series of beds in sequence, first to bed no. 1, then to bed no. 2, and so forth for numerous beds, the number of beds often being between 12 and 24. These beds may be considered to be portions of a single large bed whose movement is simulated. Each time the feed stream destination is changed, it is also necessary to change the destinations (or origins) of at least three other streams, which may be streams entering the beds, such as the feed stream, or leaving the beds. The moving bed simulation may be imply described as dividing the bed into series of fixed beds and moving the points of introducing and withdrawing liquid streams past the series of fixed beds instead of moving the beds past the introduction and withdrawal points. A rotary valve used in the Broughton process may be described as accomplishing the simultaneous interconnection of two separate groups of conduits.

U.S. Pat. No. 4,412,866 describes an example of the operation of chromatographic simulated moving bed (or sometimes called "SMB") method to separate the components of a feed stock. A resin bed is divided into a series of discrete vessels, each of which functions as a zone within a circulation loop. A manifold system connects the vessels and directs, in appropriate sequence to (or from) each vessel, each of the four media accommodated by the process. Those media are generally referred to as feed stock, eluent, extract and raffinate, respectively. As applied to a sugar factory, a typical feed stock is a lower purity sucrose solution, the eluent is water, the extract is an aqueous solution of sucrose and the raffinate is an aqueous solution containing non-sucrose, such as salts and high molecular weight compounds. The simulated moving bed disclosed by the '866 patent is of the type sometimes referred to as a "continuous SMB."

An example of a batch chromatographic method for the purification of sucrose is described in the disclosure of U.S. Pat. No. 4,359,430, which utilizes sucrose, feed stocks derived from sugar beets at purities of approximately 7% to 60% sucrose. See also, e.g., U.S. Pat. No. 5,466,294, which utilizes a "soft raw syrup" as a feedstock to a chromatographic method which is not in a high purity form at a less than 89% purity sucrose on a dry solids basis, i.e., approximately 11% non-sucrose impurities.

U.S. Pat. No. 6,057,135 discloses a method of producing d-tagatose from lactose hydrolysate, comprising glucose and d-galactose. The method comprises subjecting the lactose hydrolysate to fermentation conditions whereby the glucose is selectively fermented to ethanol. The remaining d-galactose is separated from the ethanol to provide a solution having a concentration of from about 10% to about 60% by weight d-galactose. The solution of d-galactose is subjected to enzymatic isomerization with L-arabinose isomerase at an isomerization pH from about 5.5 to about 7.0 and a temperature from about 50° C. to about 70° C. The resulting yield of d-tagatose is from about 20% to about 45% by weight based on d-galactose.

Methods are sought to simultaneously produce high purity tagatose and an enriched glucose product using a combination of galactose isomerization and continuous chromatography or simulated moving bed separation.

SUMMARY

The present invention relates to the production of highly pure tagatose and an enriched glucose product by a combination of galactose isomerization and continuous chromatographic separation from deproteinized whey or lactose. Typically, deproteinized whey is contacted with a mineral acid in a hydrolysis process wherein at least a portion of the lactose is transformed into galactose and glucose, and salts such as calcium sulfates are formed. In conventional processing, the salts and solids which are formed in the hydrolysis process or the subsequent neutralization of the hydrolysis products are removed prior to further processing such as an isomerization process to isomerize at least a portion of the galactose into tagatose. It was surprisingly discovered that by passing the hydrolysis product directly to the isomerization zone without removing any solids or salts resulted in an improved isomerization selectivity and yield of the desired tagatose product. Furthermore, the postponing of the removal of the solids and salts until after the isomerization step in the overall process eliminated a separation and removal step which reduced the overall capital and operating cost of the complex.

In one embodiment, the invention is a process for the production of high purity tagatose and high purity glucose from a condensed deproteinized whey stream. The process comprises passing the condensed deproteinized whey stream to a hydrolysis zone and therein admixing the condensed deproteinized whey stream with a dilute sulfuric acid stream at effective hydrolysis conditions to hydrolyze at least a portion of the deproteinized whey stream in the presence of an effective amount of sulfuric acid to provide a hydrolysate stream comprising d-galactose, d-glucose, unconverted lactose, sulfuric acid, water and salts. The hydrolysate stream is passed to a first neutralization zone and therein the hydrolysate stream is contacted with an effective amount of calcium hydroxide to provide an unfiltered neutralized hydrolysate stream comprising d-galactose, d-glucose, unconverted lactose, water and salts. The unfiltered neutralized hydrolysate stream is passed to an isomerization zone in the presence of an effective amount of calcium oxide and calcium chloride to convert at least a portion of the d-galactose to d-tagatose and d-glucose to provide an isomerate stream comprising d-galactose, d-glucose, lactose, d-tagatose, water, and salts. The isomerate stream is passed to a second neutralization zone and therein contacted with an effective amount of sulfuric acid to neutralize the isomerate stream and provide a neutralized isomerate stream having a pH of between about 6 and about 7. The neutralized isomerate stream is passed to a filtration zone having a filter size effective to remove at least a portion of the salts to provide a filtered isomerate stream essentially free of salts comprising d-galactose, d-glucose, lactose, d-tagatose, and water. The filtered isomerate stream and a mobile phase desorption stream comprising water are passed to a simulated moving bed (SMB) zone containing a plurality of adsorbent beds comprising a stationary phase agent consisting of a strong acid calcium cation exchange resin to provide an extract stream comprising substantially pure d-tagatose, water, and a minor portion of d-galactose, a primary raffinate stream comprising water, d-galactose, and d-glucose, and a secondary raffinate stream consisting essentially of water. The extract stream is passed to a first evaporization zone to remove at least a portion of the water to provide an evaporated extract stream. The evaporated extract stream is passed to a crystallizer zone to provide a high purity d-tagatose stream in the form of a powder or crystals. The primary raffinate stream is passed to a second evaporator to provide an enriched d-glucose syrup; and at least a portion of the secondary raffinate is returned to step (f) to provide at least a portion of the mobile phase desorbent stream.

DETAILED DESCRIPTION OF THE INVENTION

Figure 1:
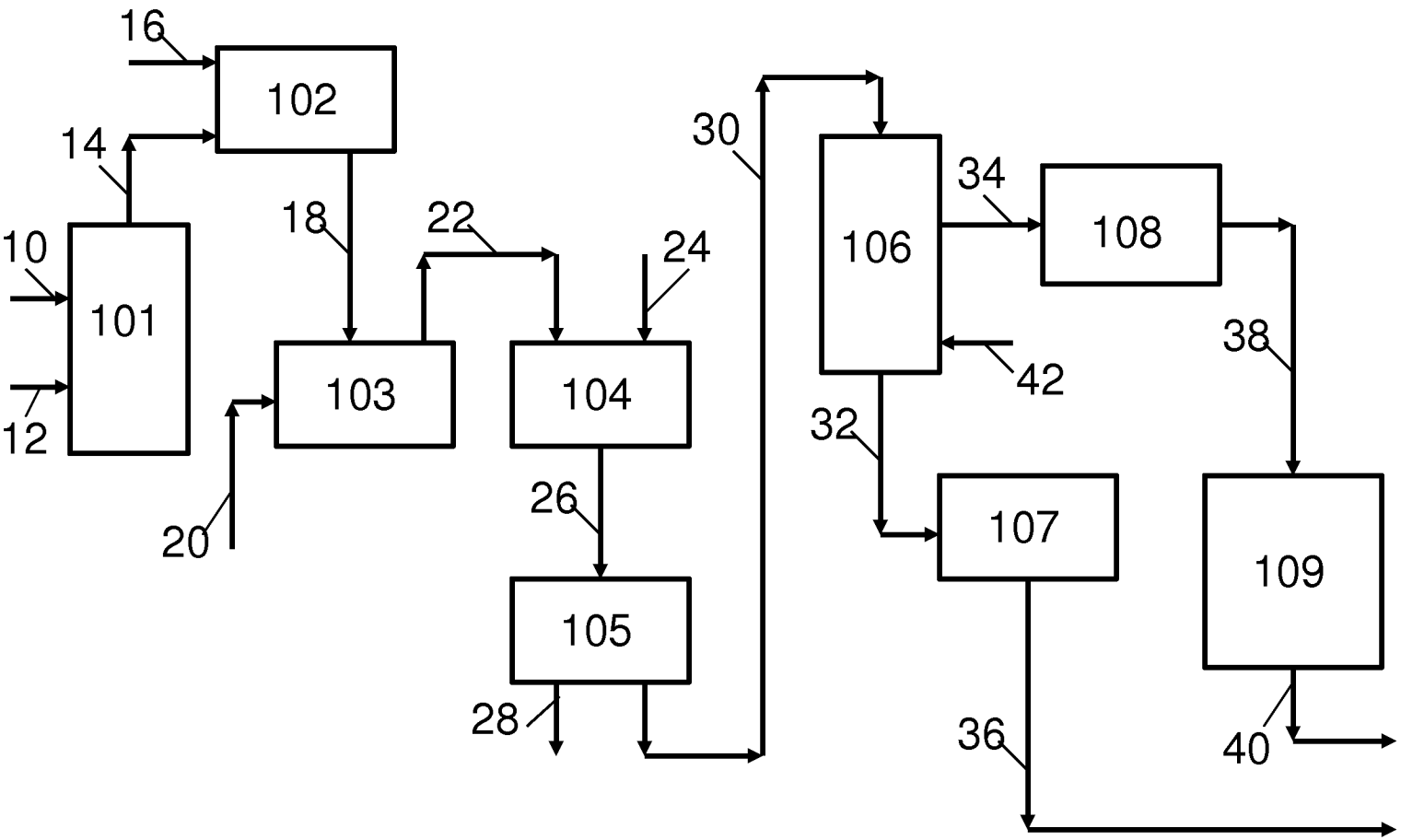
FIG. 1 is a schematic process flow diagram representing an embodiment of the present invention for the production of high purity d-tagatose and high purity d-glucose from deproteinized whey.

D-galactose and d-glucose are produced by the hydrolysis of deproteinized whey or lactose. According to the present invention, the hydrolysis reaction is carried out in a hydrolysis reaction zone by admixing the condensed deproteinized whey or lactose in liquid form with a dilute sulfuric acid stream to provide a lactose concentration of between about 10 to about 30 wt-% to form a diluted lactose stream. More preferably, the deproteinized lactose is admixed with a dilute sulfuric acid to provide a lactose concentration of between about 25 to about 30 wt-% in the diluted lactose stream. The dilute sulfuric acid stream has a sulfuric acid concentration of from about 1 to about 12 wt-% of the sulfuric acid in deionized water. More preferably, the sulfuric acid stream has a sulfuric acid concentration of from about 10 to about 12 wt-% of the sulfuric acid in deionized water. The hydrolysis step has a reaction time ranging from about 20 to about 50 hours. More preferably, the hydrolysis step has a reaction time ranging from about 36 to about 50 hours. The hydrolysis reaction is carried out at a hydrolysis temperature of from about 40 to about 80° C. More preferably, the hydrolysis reaction is carried out at a hydrolysis temperature of from about 70 to about 80° C. The pH of the hydrolysis reaction comprises a pH from about 1 to about 3, and more preferably, the hydrolysis reaction comprises a pH from about 2 to about 3. The effective amount of sulfuric acid in the hydrolysis zone comprises, on a dry weight basis, a lactose to sulfuric acid ratio of about 2.1:1 or 2:1.1 lactose:sulfuric acid. The resulting conversion of lactose in the hydrolysis reaction ranges from about 80 to about 95 wt-%.

In a conventional lactose hydrolysis process as exemplified by U.S. Pat. No. 6,057,135 for the recovery of tagatose, the deproteinized whey or lactose is introduced to a fermentor contacted with an enzyme such as immobilized lactase enzyme in a hydrolysis process to produce equal amounts of d-glucose and d-galactose. The effluent from the enzyme hydrolysis is desalted and the desalted effluent is passed to a fermentation zone wherein the glucose is converted to ethanol and the ethanol is removed by distillation. However, in the conventional glucose fermentation zone using enzyme, a small amount of glycerol can be formed in an amount ranging from about 5 to about 10 wt-% based on the amount of glucose converted. The presence of glycerol in the fermentation product cannot be removed by distillation because the boiling point of glycerol is greater than ethanol. Thus, at least a portion of the glycerol remains in the high purity tagatose syrup which reduces the yield of high purity tagatose final product in a subsequent crystallization step.

In the instant invention the deproteinized whey or lactose is transformed into d-galactose and d-glucose, along with the formation of salts such as calcium sulfates or other non-soluble solids. The hydrolysis effluent was neutralized by the addition of calcium hydroxide or calcium oxide as a slurry in an amount equivalent to about 80 to about 90 mol-% of the mineral acid added to the hydrolysis reaction to reduce the pH of the hydrolysis reaction mixture to a pH of between about 6.5 to about 7.0. The salts formed in the hydrolysis process and the calcium sulfate formed in the subsequent neutralization of the hydrolysis products are not removed prior to further processing. The unfiltered effluent from the hydrolysis of the deproteinized whey or lactose is neutralized and then passed directly to an isomerization process to isomerize at least a portion of the d-galactose into d-tagatose. It was surprisingly discovered that by passing the unfiltered hydrolysis product directly to the isomerization zone without removing any solids or salts resulted in improved isomerization selectivity, improved yield of the desired d-tagatose product, and improved overall reaction rate. As shown hereinbelow in Table 1, there is a significant advantage in the isomerization zone for the isomerization reaction to take place in the presence of the salts and non-soluble materials.

TABLE 1

Comparison of Filtered and Unfiltered Lactose Hydrolysate Feeds in Isomerization Reaction

| | UnFiltered Hydrolysate | Filtered Hydrolysate |
|---|---|---|
| Galactose Conversion, Percent | 74 | 74 |
| Conversion Time, min* | 210 | 270 |
| Sugar Loss, wt-% | 1 | 4.8 |
| Tagatose Yield, % | 97.4 | 94.5 |
| T/G Ratio ** | 3.08 | 2.68 |

*Based on time required to reach 74 percent conversion

** At Desired Conversion, i.e. 74% Tagatose/Galactose Ratio by wt

It was observed that the rate of the isomerization reaction was faster when the $CaSO_4$ salts and other salts formed after hydrolysate neutralization were allowed to remain in the solution compared to when the $CaSO_4$ and salts were removed by filtration prior to the isomerization reaction. The overall conversion of galactose to d-tagatose without formation of any di- or poly-saccharides was limited to about 60%. The isomerization reaction time with the $CaSO_4$ salts present for 74% conversion of d-galactose was 210 minutes, compared to 270 min or more when operating after filtering $CaSO_4$ salts. It is believed that the observed increase in reaction rate was attributed to excess surface available for isomerization reaction to take place, and the excess of calcium ions present in reaction mixture. Furthermore, the losses to the production of unknown sugars at 74 percent conversion were 1 wt-% for the unfiltered isomerization feed, compared to 4.8 wt-% production of unknown sugars for the filtered isomerization feed. The unfiltered isomerization feed showed a d-tagatose yield advantage of almost 3 weight percent (97.4 wt-%) over the filtered isomerization feed (94.5 wt-%), and the ratio of d-tagatose to d-galactose (T/G) was about 15 percent higher for the unfiltered isomerization feed, compared to the filtered isomerization feed.

In comparing the process of the instant invention to the prior art exemplified by U.S. Pat. No. 6,057,135, there are additional process advantages of using an acid hydrolysis as recited hereinabove over the use of enzymatic conversion of d-glucose to ethanol and the subsequent separation of the ethanol by distillation. The prior art process scheme results in a sugar stream comprising from about 5 to 10 wt-% glycerol. The presence of this glycerol in the product sugar stream reduces the crystallization yield of the final tagatose product. The process of the instant invention eliminates the enzymatic step and does not require the ethanol separation and does not introduce any glycerol into the product sugar stream. Furthermore, the instant invention only requires a single SMB separation of Tagatose from Glucose and unconverted Galactose to provide a high purity tagatose product, thereby reducing production costs. The Glucose/Tagatose SMB operation of the present invention is more selective compared to a Galactose/Tagatose separation and the resulting primary raffinate stream of the present invention is an enriched d-glucose stream which can be concentrated to a an enriched d-glucose syrup having commercial value as a byproduct.

The present invention relates to the production of d-tagatose from deproteinized whey (lactose). Lactose can be effectively hydrolyzed in presence of sulfuric acid (pH 2-2.5) to dissociate into d-glucose and d-galactose. D-galactose can be isomerized selectively to d-tagatose in basic conditions using calcium oxide or calcium hydroxide and calcium chloride as catalyst. Because the d-galactose isomerization reaction to d-tagatose occurs rapidly in the presence of calcium oxide or calcium hydroxide, the reaction must be moderated to maximize the production of the d-tagatose while minimizing the degradation of the d-tagatose to less valuable byproducts. The isomerization temperature, that is, the temperature at which the isomerization reaction zone is maintained, is between about 12 and about 16° C. At a point in the isomerization reaction, such as when the desired conversion is achieved, the isomerization reaction mixture is neutralized with dilute sulfuric acid to provide a pH of between 6 and 7 to stop the isomerization reaction. In the present invention, it was found that the desired point for terminating the isomerization reaction was between about 70 and about 75 percent conversion by weight. More preferably the desired point for terminating the isomerization reaction was about 74 percent by weight. At the conclusion of the neutralization step, essentially all calcium oxide present in the isomerization reaction effluent has been converted to calcium sulfate. The calcium sulfate is subsequently removed by filtration of the neutralized isomerization effluent.

Unless otherwise noted in this specification, the term tagatose means d-tagatose, the term galactose, means d-galactose, and the term glucose means d-glucose.

A conventional SMB separation process typically comprises passing a feed stream and a mobile phase stream to an SMB zone and recovering an extract stream and a raffinate stream. Applicant surprisingly discovered that by amending the conventional SMB process cycle to include an expanded adsorption zone to provide multiple raffinate streams, significant capital cost and operating cost savings could be obtained by eliminating a separate mobile phase recovery zone for the removal of the mobile phase from the raffinate stream which can be employed to offset the requirement for the mobile phase stream.

The stationary phase agent of the present invention can be a strong acid cation exchange resin having a cation selected from the group consisting of sodium, calcium, ammonium, and mixtures thereof. It is preferred that the stationary phase agent employed in the SMB be a strong acid calcium exchanged resin. It was discovered that the particle diameter of the strong acid calcium exchange resin had an effect on the purity and the recovery of the tagatose obtained. The preferred median average diameter of the strong acid calcium exchanged resin comprises a particle diameter of between about 190 and about 330 microns. More preferably, the median average diameter of the strong acid calcium exchanged resin comprises a particle diameter of between about 190 and about 250 microns.

DETAILED DESCRIPTION OF THE DRAWINGS

A commercial embodiment of the SMB system of the current invention will arranged for maximum selectivity. The simulated moving bed operation is achieved by use of a plurality of adsorbent beds connected in series and a complex valve system, whereby the complex valve system facilitates switching at regular intervals the feed entry in one direction, the mobile phase desorbent entry in the opposite direction, while changing the extract and raffinate takeoff positions as well. The SMB system is a continuous process. Feed enters and extract and raffinate streams are withdrawn continuously at substantially constant compositions. The overall operation is equivalent in performance to an operation wherein the fluid and solid are contacted in a continuous countercurrent manner, without the actual movement of the solid, or stationary phase adsorbent.

The operation of the SMB system is carried out at an SMB temperature ranging from about 55 to about 65° C. within the adsorbent bed to maintain a relatively constant temperature regime throughout the SMB zone. The feed stream is introduced and components are adsorbed and separated from each other within the adsorbent bed. A separate liquid, the mobile phase desorbent, or desorbent, is used to counter currently displace the feed components from the pores of the stationary phase adsorbent. During the SMB cycle of the present invention, adsorbent beds are advanced through a desorption zone, a rectification zone, an adsorption zone, and a regeneration zone. The description of the SMB cycle as a 2-3-2-1 cycle means that in the cycle, 2 adsorbent beds are in the desorption zone, 3 adsorbent beds are in the rectification zone, 2 adsorbent beds are in the adsorption zone, and 1 adsorption bed is in a solvent recovery zone.

With reference to FIG. 1, FIG. 1 shows one embodiment of the invention. According to FIG. 1, a condensed deproteinized whey (lactose) stream in line 10 is passed along with stream 12 comprising about a 10 wt-% solution of sulfuric acid to a hydrolysis zone 101, wherein the condensed deproteinized whey (lactose) is diluted to a lactose concentration of between about 10 and about 30 wt-%. At least a portion of the lactose is hydrolyzed in the hydrolysis zone 101 to provide a lactose hydrolysate stream in line 14, comprising d-galactose, d-glucose, acid, lactose, water, and insoluble matter. The lactose hydrolysate stream in line 14 is passed to a neutralization zone 102 and therein contacted with a calcium hydroxide introduced in line 16 to neutralize the acid to form calcium sulfate and to provide a first neutralized stream in line 18 comprising d-galactose, d-glucose, lactose, water, salt (calcium sulfate), and insoluble matter. The calcium sulfate is essentially undissolved in the first neutralized stream. The first neutralized stream in line 18 is passed to a d-galactose isomerization zone 103 directly, without removing the salt (calcium sulfate) and therein contacted with calcium oxide or calcium hydroxide and calcium chloride introduced in line 20 to provide an isomerate stream in line 22 comprising, d-galactose, d-glucose, lactose, d-tagatose, water, salt (undissolved calcium sulfate), and insoluble matter. The isomerate stream in line 22 is passed to a second neutralization zone wherein the isomerate stream in line 22 is contacted with a second sulfuric acid stream in line 24 to provide a second neutralized stream in line 26 comprising d-galactose, d-glucose, lactose, water, d-tagatose, insoluble matter, and salt such as calcium sulfate. The second neutralized stream in line 26 is passed to a filtration zone having a filter size of less than or equal to 0.45 microns to remove at least a portion of the salt such as calcium sulfate and insoluble matter to provide a filtered stream in line 30. The filtered stream in line 30 and a mobile phase desorbent stream in line 42 are passed to a simulated moving bed (SMB) zone 106 to provide an extract stream in line 34 comprising d-tagatose, d-galactose, and water; and, a primary raffinate stream comprising d-glucose and water in line 32. A secondary raffinate stream comprising the mobile phase desorbent (not shown in FIG. 1) is also produced and recycled or returned to the SMB zone to offset the consumption of the mobile phase desorbent (See FIG. 2). The extract stream in line 34 is passed to a second evaporator to remove at least a portion of the water from the extract stream to provide a second evaporator effluent stream in line 38 and passing the second evaporator effluent stream to a d-tagatose crystallizer to provide a high purity tagatose product in line 40 comprising essentially pure d-tagatose crystals, wherein essentially pure d-tagatose (i.e., 90-99 wt % of tagatose, based on total sugar, and the supernatant or mother liquor being a minor portion of galactose). The primary raffinate stream in line 32 is passed to a third evaporator zone 107 to remove at least a portion of the water in the primary raffinate stream and to provide an evaporated primary raffinate stream in line 36. The evaporated primary raffinate stream in line 36 comprises highly enriched glucose comprising substantially pure d-glucose (i.e., 75-80 wt-% pure d-glucose and a minor portion of d-galactose, based on total sugar mass).

Figure 2:
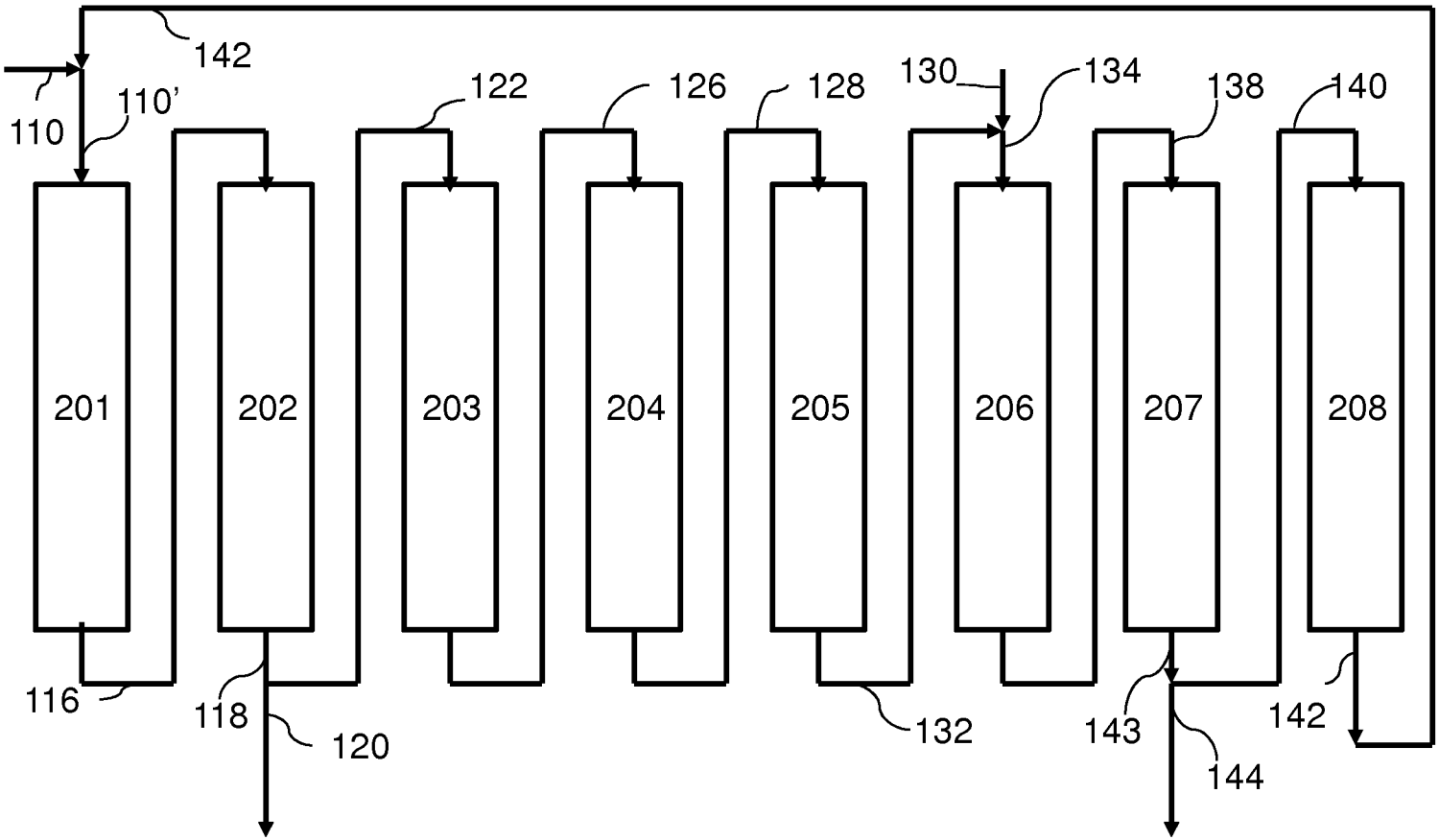
FIG. 2 is a schematic process flow diagram illustrating a liquid phase simulated moving bed separation zone for an 8 adsorbent bed arrangement for the production of high purity d-tagatose and high purity d-glucose.

With reference to FIG. 2, FIG. 2, shows an embodiment of a nominally isothermal all liquid phase simulated moving bed SMB adsorption zone based on an 8 adsorbent bed arrangement for the production of high purity d-tagatose and high purity d-glucose. Adsorbent beds 201-208, containing a stationary phase adsorbent such as a strong acid calcium cation exchange resin selective for the adsorption of d-tagatose and operated at effective tagatose separation conditions are disposed in a serial configuration such that in accordance with a prearranged cycle, conduit 116 provides fluid communication between the bottom of adsorbent bed 201 with the top of adsorbent bed 202, conduits 118 and 122 provide fluid communication between the bottom of adsorbent bed 202 bed and the top of adsorbent bed 203, conduit 126 provides fluid communication between the bottom of adsorbent bed 203 with the top of adsorbent bed 204, conduit 128 provides fluid communication between the bottom of adsorbent bed 204 with the top of adsorbent bed 205, conduits 132 and 134 provide fluid communication between the bottom of adsorbent bed 205 with the top of adsorbent bed 206, conduit 138 provides fluid communication between the bottom of adsorbent bed 206 with the top of adsorbent bed 207, conduits 143 and 140 provide fluid communication between the bottom of adsorbent bed 207 with the top of adsorbent bed 208, and conduit 142 provides for the withdrawal of fluid from the bottom of adsorbent bed 208. According to the prearranged SMB cycle, an SMB zone feed stream is passed to the isothermal SMB adsorption zone in line 130 and 134 to adsorbent bed 206. A primary raffinate stream is withdrawn from adsorbent bed 207 via conduits 143 and 144, a secondary raffinate stream is withdrawn from adsorbent bed 208 in line 142, and an extract stream is withdrawn from via conduits 118 and 120 from adsorbent bed 202. A liquid desorbent stream comprising water is introduced to adsorbent bed 201 in conduit 110 and 110'. At least a portion of the secondary raffinate stream in conduit 142 is returned to adsorbent bed 201 and admixed with the liquid desorbent stream in line 110 to provide recovered mobile phase desorbent. The adsorbent beds 201-208 are indexed according to a 2-3-2-1 SMB cycle such that at least 2 adsorbent beds undergo desorption, at least 3 adsorbent beds undergo rectification, and at least 2 adsorbent beds undergo adsorption, and at least one adsorbent bed is a solvent recovery zone and undergoes regeneration and recovery of mobile phase desorbent during the SMB cycle. In a commercial implementation of the present invention, the number of actual adsorbent beds in a particular zone of the SMB is a matter of economic choice and valve size limitations.

The present invention is further described by the following examples.

EXAMPLES

Stationary Phase Evaluation Example 1

Pulse Test of d-Glucose-d-Tagatose Separation

A test chromatographic column of 316 stainless steel and having an inside diameter of 10 mm and a length of 250 mm was prepared for liquid chromatography (LC) for use in establishing the elution profile for d-glucose, d-galactose, and d-tagatose for each stationary phase agent tested. One chromatographic column was filled with about 15.2 gm of DOWEX MONOSPHERE 99Ca/320 (Available from The Dow Chemical Company, Midland, Mich.), a strong acid cation exchange resin in calcium form (or strong acid calcium exchange resin) as stationary phase. Another test column was filled with about 16.3 gm of Mitsubishi DIAION UBK 555 (Available from Mitsubishi Chemical Corporation, Tokyo, Japan) a strong acid exchange resin in calcium form. The DOWEX resin particles were in the form of beads and were nominally 300-330 microns in diameter, and the DIAION particles were nominally 190-240 microns in diameter. Separate 5 wt-% solutions of d-glucose, 5 wt-% d-galactose, and 5 wt-% d-tagatose in deionized water were prepared to inject separately into each chromatography column. The injection volume was about 250 ul. A flow of mobile phase desorbent as deionized water at a rate of 0.5 ml/min was established in the column at a temperature of 65° C. The column was maintained at a temperature of 65° C. Each of the solutions was injected into the column and the eluent from the chromatographic column was monitored by refractive index using a Waters 410 RI detector (Available from Waters Corporation, Milford Mass.). The compositions were analyzed by HPLC. The relative selectivities for each of the sugar species over the DOWEX 99 Ca/320 and the DIAION UBK 555 resins were calculated and are shown hereinbelow in Table 1A. The relative selectivity was determined by considering the retention times for each of the components and the void marker time of the column.

TABLE 1A

Relative Selectivities

| | Relative Selectivity (alpha) With respect to Glucose | |
|---|---|---|
| Components | DIAION UBK 555 | DOWEX 99CA/320 |
| Glucose | 1 | 1 |
| Galactose | 1.5 | 1.15 |
| Tagatose | 3.25 | 3 |

Clearly, on the basis of the relative selectivity for the tagatose with respect to glucose, the DIAION UBK 555 performed better than the DOWEX MONOSPHERE 99Ca/320, although both resins were acceptable.

SMB Evaluation Example 2a

SMB Run with DOWEX 99 Ca/320

The purity of the tagatose recovered as a function of tagatose recovery was measured in an SMB unit. A lab scale SMB unit (OCTAVE-300 unit, available from Semba Biosciences, Inc. Madison, Wis.) was used for separation of individual components of isomerate stream (equivalent of stream in line 30 of FIG. 1). The Semba Octave-300 Chromatography System is a bench top automated liquid chromatography platform designed for preparative-scale purification of chemical and biological compounds. The Octave System carries eight column positions arranged in series and connected through a proprietary pneumatic valve array. The independently working and programmable 72-valve array contains no moving parts, occupies only 3 μl per valve, and responds within 100 ms. Fluid flow is controlled by four independent pumps. The valve switching and pump flow rates are controlled via the SembaPro Software. Eight adsorbent beds, each comprising a SS316 column having an inside diameter of 22 mm and a length of 300 mm were packed with about 90.4 grams of DOWEX Monosphere 99Ca/320 resin, a strong acid cation exchange resin in calcium form, (Available from The Dow Chemical Company, Midland, Mich.). The SMB unit was operated in a 2-3-2-1 column configuration with the operating conditions shown hereinbelow in Table 2A. The desorbent or mobile phase is low conductivity RO water (20-50 micro Siemens). The columns were arranged in a water bath in temperature range of 55-70 deg C., and on average 65 deg C. The resulting tagatose purity as a function of tagatose recovery is shown hereinbelow in Table 2A.

TABLE 2A

| SMB Operating Parameters | |
|---|---|
| Stream | Flow rate (ml/min) |
| Feed | 0.9 |
| Desorbent (RO water) | 6.1 |
| Extract | 1.4 |
| Primary Raffinate | 1.8 |
| Secondary Raffinate | 3.8 |
| Step Time | 900 sec |

SMB Evaluation Example 2B

SMB Run with DIAION UBK 555

Eight columns made up of SS316 as material of construction and having an inside diameter of 22 mm and a length of 300 mm were filled with about 96.6 grams of Mitsubishi DIAION UBK 555 (Available from Mitsubishi Chemical Corporation, Tokyo, Japan)

The SMB unit was operated in a 2-3-2-1 column configuration and with the flow conditions show herein below in Table 2B. The desorbent or mobile phase is low conductivity RO water (20-50 micro Siemens). The columns are arranged in a water bath in temperature range of 55-70 deg C. and most preferably 65 deg C. The resulting tagatose purity as a function of recovery is shown herein below in Table 2C.

TABLE 2B

| SMB Operating Parameters | |
|---|---|
| Stream | Flow rate (ml/min) |
| Feed | 0.9 |
| Desorbent (RO water) | 5.9 |
| Extract | 1.2 |
| Primary Raffinate | 2.0 |
| Secondary Raffinate | 3.8 |
| Step Time | 900 sec |

(*Flow Conditions for the maximum tagatose purity)

TABLE 2C

| Comparison of tagatose purity as a function of tagatose recovery | | |
|---|---|---|
| | Percent Tagatose Recovery | |
| Tagatose Purity, % | DIAION 555 | DOW 99CA/320 |
| 99 | 81 | |
| 98 | 84 | |
| 97 | 87 | |
| 96 | 89 | 60 |
| 95 | 91 | 64 |
| 90 | 95 | 70 |
| 87 | 97 | 73 |
| 85 | 98 | 75 |

As shown in Table 2C, using the smaller particle DIAION Ca resin resulted in a greater tagatose recovery and purity than the larger particle DOW 99CA/320 resin.

Process Example 1

Figure 3:
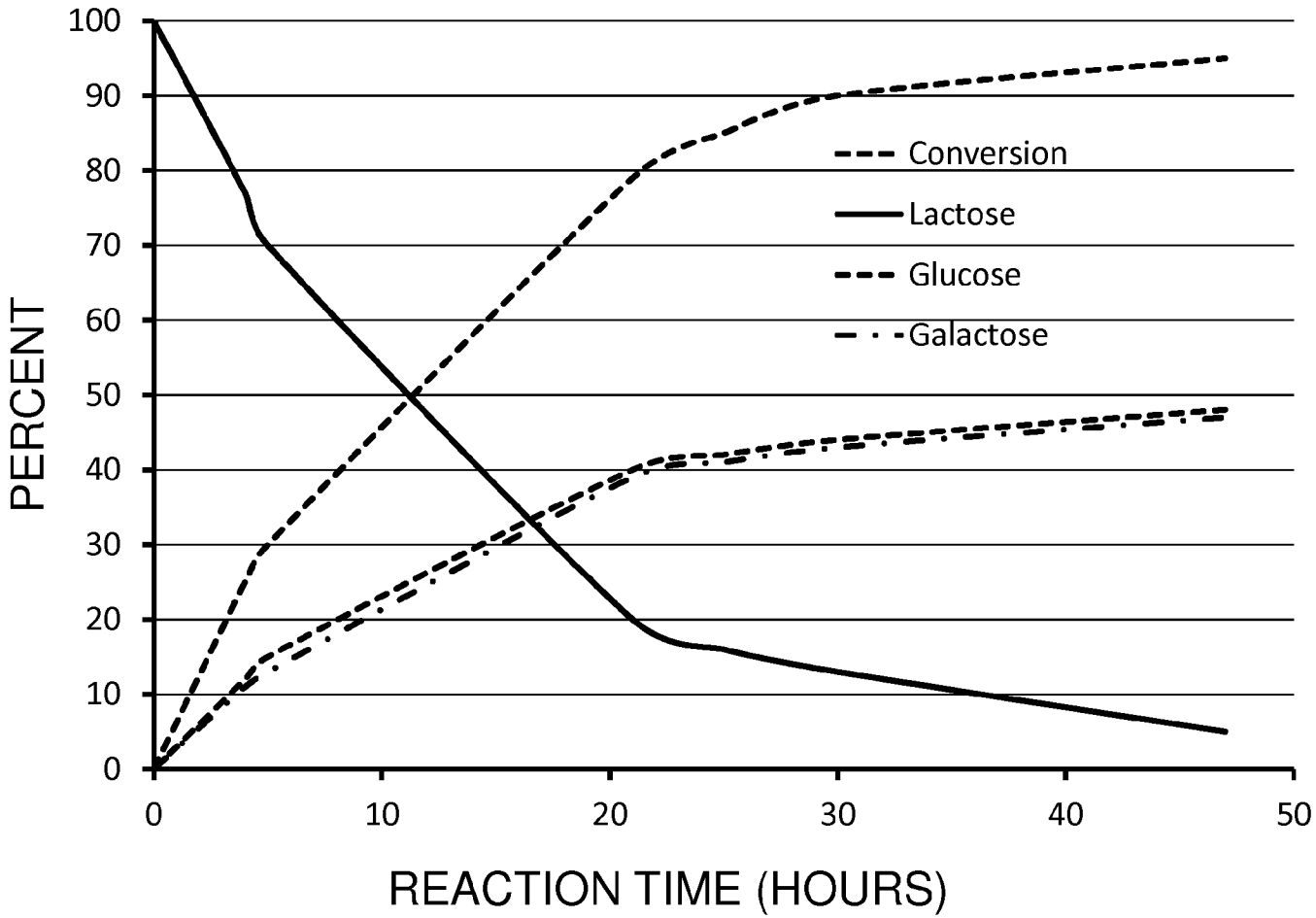
FIG. 3 is a chart showing the concentrations of lactose, glucose, galactose and conversion in a lactose acid hydrolysis reaction step as a function of reaction time according to the present invention.

Whey Hydrolysis 600 grams of condensed deproteinized whey condensate (dry wt basis) was placed in a continuous stirred glass reactor. 3 liters of 10 wt % sulfuric acid (or 300 grams in 2700 ml water) was added slowly to the continuous stirred glass reactor over a period of 30 minutes. The continuous stirred glass reactor was heated using a jacket heater while being continuously stirred. The reaction temperature was maintained at 70 deg C. Samples were removed from the continuous stirred glass reactor at intervals and analyzed over HPLC to determine the lactose conversion and formation of d-glucose and d-galactose. FIG. 3 shows a plot of the percentage conversion over the reaction time. It was observed that the optimum conditions for the 95% lactose conversion were: 2:1 molar ratio of Lactose:sulfuric acid (dry wt basis) and temperature in the range of 65-80 deg C., and most preferably 70 deg C. The pH of the mixture was in the range of from 2.0 to 2.5. The reaction completion time was 36-45 hours and appeared to be a function of agitation/mixing. At the end of reaction, the mixture was neutralized using equimolar amount of $Ca(OH)_2$ or 226.5 grams in order to provide a pH in the range of 6.5-7. The neutralized reaction mixture was allowed to cool down to room temperature (20 deg C.) before being used for the isomerization reaction. The neutralized reaction mixture was composed of about 285 grams each of d-glucose and d-galactose, 30 grams of unconverted lactose, 416 grams of calcium sulfate salts and the remained was non-soluble matter including denatured protein remains.

Process Example 2

Galactose Isomerization—with Salts

Figure 4:
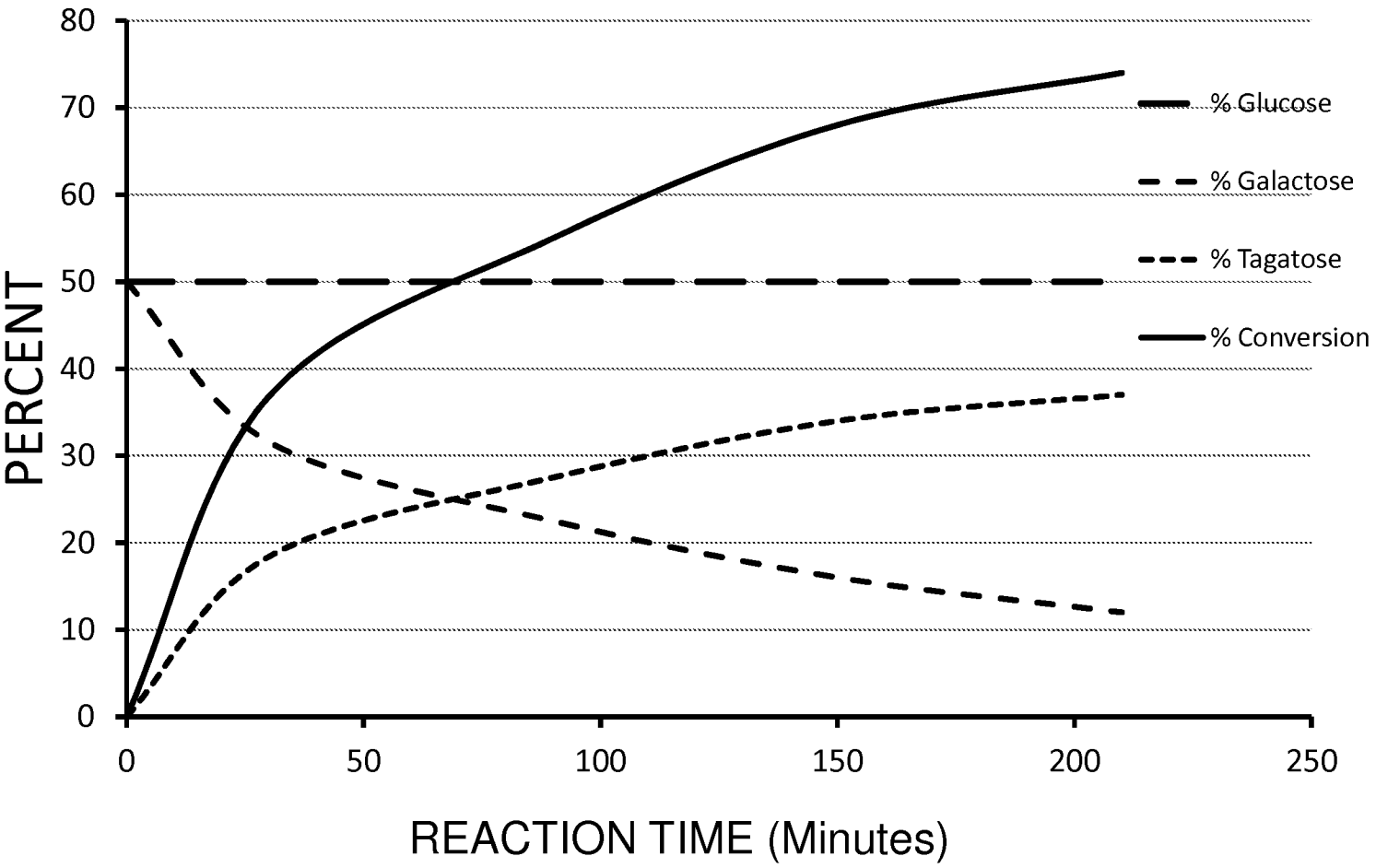
FIG. 4 is a chart showing the concentrations of d-glucose, d-galactose, d-tagatose, and conversion in a galactose isomerization reaction step as a function of reaction time according to the present invention using an unfiltered isomerization feed.

The lactose hydrolysate prepared in Process Example 1 was passed to a d-galactose isomerization zone maintained at about 9-14 deg C. and most preferably 12 deg C. The isomerization reaction mixture pH was maintained within the range of 12-13 by addition of an effective amount of CaO and $CaCl_2$. The galactose/calcium oxide molar ratio was 1:1 and $CaCl_2$ added was 5 mol % of galactose. In particular, 186.6 grams of CaO and 18.3 grams of $CaCl_2$ were added to the isomerization reaction mixture. The isomerization reaction mixture was continuously stirred and periodically samples were withdrawn and analyzed by HPLC to determine the percentage of tagatose formed. Upon reaching the desired degree or percentage of conversion, an equimolar amount of sulfuric acid was added to isomerization reaction mixture in order to neutralize the isomerization reaction mixture to a pH of 6.5-7, which required the addition of 343 grams of diluted sulfuric acid (10 wt-%). The results of the galactose isomerization reaction are shown in FIG. 4 as a plot of percent conversion versus reaction time in minutes. It was observed that the rate of reaction was faster when $CaSO_4$ formed after hydrolysate neutralization was allowed to remain in the solution compared to when the $CaSO_4$ was filtered out. The overall conversion of d-galactose to d-tagatose without formation of any di or poly saccharides was limited to about 60%. The final conversion was 74%. The reaction time for 74% conversion was 210 minutes without using a filtered isomerization zone feed compared to 270 min or more when operating after filtering $CaSO_4$ salts. It is believed that the observed increase in reaction rate was attributed to excess surface available for isomerization reaction to take place and the excess of calcium ions present in mixture. The final isomerate composition was lactose: 30 gms, d-glucose: 285 grams, d-galactose: 114 grams, d-tagatose: 171 grams, $CaSO_4$: 892 grams. The mixture was then filtered after the isomerization step using 0.45 um filter to remove insoluble material as well as precipitated $CaSO_4$ salts.

Process Example 3

Galactose Isomerization—without Salts

Figure 5:
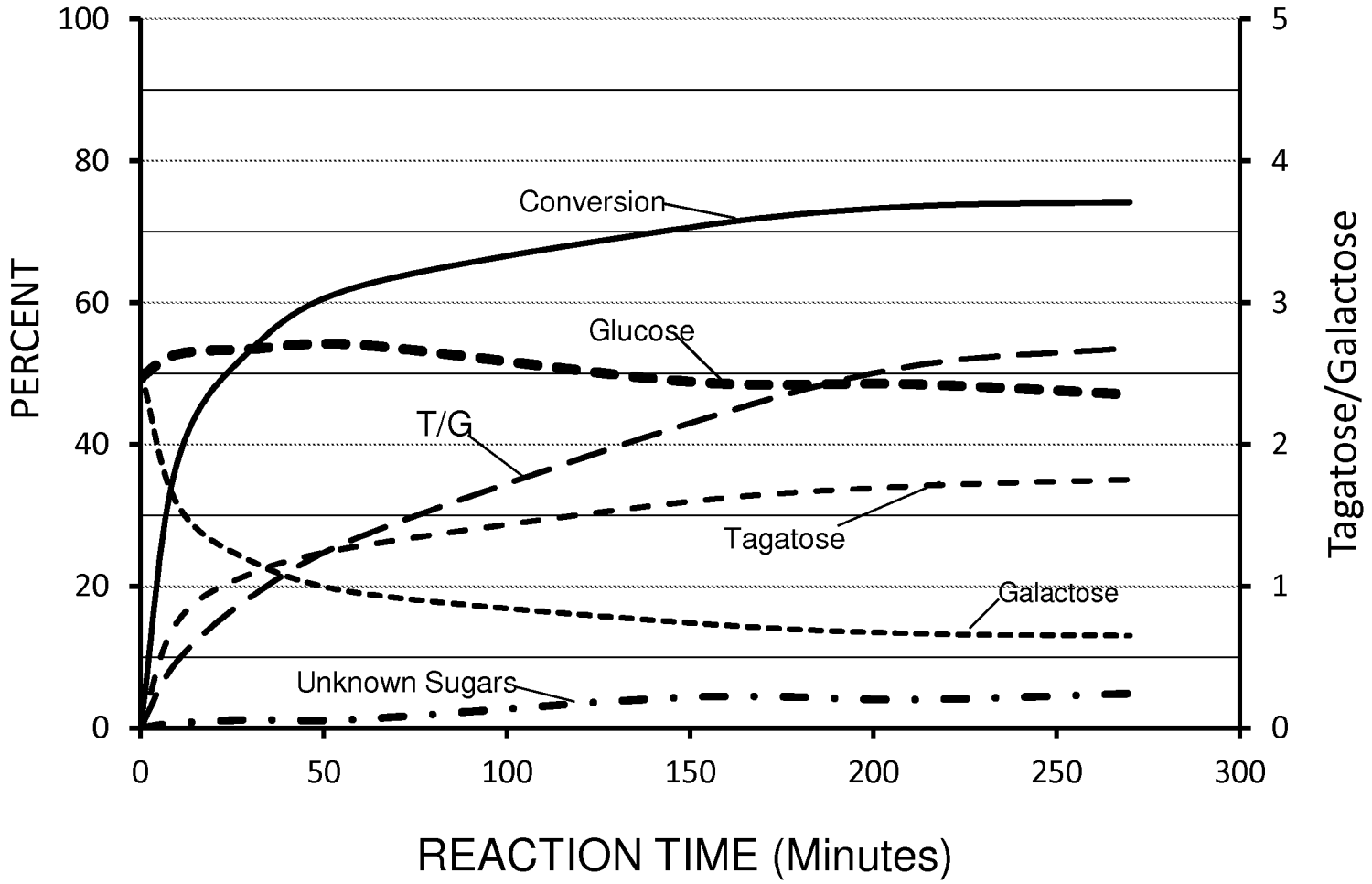
FIG. 5 is a chart showing the concentrations of d-glucose, d-galactose, d-tagatose, and conversion in a galactose isomerization reaction step as a function of reaction time with filtered isomerization feed.

The procedure of Process Example 2 was repeated using the lactose hydrolysate prepared in Process Example 1 and then filtered using a 0.45 um filter to remove insoluble material and precipitated $CaSO_4$ salts to provide a filtered hydrolysate. The filtered hydrolysate was passed to a galactose isomerization zone maintained at about 12-14° C. The isomerization reaction mixture pH was maintained at about 12 by addition of an effective amount of CaO and $CaCl_2$. The results of the galactose isomerization reaction for the filtered hydrolysate are shown in FIG. 5 as a plot of percent conversion versus reaction time in minutes. The appearance and disappearance of the components are also shown as a function of reaction time along the right-hand y-axis. The ratio of d-tagatose to d-galactose (T/G) as a function of reaction time is shown along the right-hand y-axis. Unlike the unfiltered isomerization feed shown in FIG. 4, there is a significant yield loss of tagatose appearing as the conversion of the galactose to unknown sugars which reached a value of 4.8 wt-% of the total sugar at the desired conversion. The overall yield of d-tagatose from the reaction of the filtered isomerization feed was 94.5 wt-% compared to a yield of d-tagatose of 97.4 wt-% of total sugars for the unfiltered isomerization feed.

Process Example 4

Tagatose by SMB Separation

As described in Example 2a, hereinabove, a lab scale SMB unit (OCTAVE-300 unit, available from Semba Biosciences, Inc. Madison, Wis.) was used for separation of individual components of isomerate stream. Eight adsorbent beds, each comprising a SS316 column having an inside diameter of 22 mm and a length of 300 mm were packed with about 98 grams of DOWEX 99CA/320 resin, a strong acid cation exchange resin in calcium form, (Available from The Dow Chemical Company, Midland, Mich.). The SMB unit was operated in a 2-3-2-1 column configuration with the conditions show hereinabove in Table 2A. The desorbent or mobile phase is low conductivity RO water (20-50 micro Siemens). The columns were arranged in a water bath in temperature range of 55-70 deg C. and most preferably 65 deg C. The extract stream comprised 95% or more tagatose and 5% or less galactose and was passed to an evaporator to remove up to about 70 wt % or more of the water and was then crystallized to make crystals comprising about 99 wt % or more d-tagatose crystals. The primary raffinate comprising about 75 wt % glucose and remaining amount being galactose was sent to evaporator to concentrate the enriched glucose stream to provide a syrup which can be sold as high glucose content syrup. The secondary raffinate was recycled or returned to the SMB zone and admixed with the mobile phase desorbent stream.

Process Example 5

Comparative Production Example

U.S. Pat. No. 6,057,135 in column 5, lines 1 to 41 and FIG. 1 (of U.S. Pat. No. 6,057,135), which are hereby incorporated by reference, discloses a scheme for the production of d-tagatose from a deproteinized lactose wherein the a desalinated and filtered deproteinized lactose comprising an approximately equal amounts of d-glucose and d-galactose is introduced to a fermentor for the production of ethanol (from the fermentation of d-glucose) and the formation of glycerol. The ethanol is removed from the fermentor by vacuum and passed to a distillation column for the separation of the ethanol to provide an ethanol stream and a galactose rich stream. The galactose rich stream is isomerized to d-tagatose and the isomerate is passed to a group of parallel cation exchange columns wherein the galactose and the d-tagatose are selectively eluted. The galactose stream is recycled and the tagatose stream is evaporated and crystallized to provide tagatose crystals. One problem of this scheme is the formation of glycerol in the fermentation step such that about 5-10% glycerol remains in d-tagatose rich stream, thereby reducing the crystallization yield significantly. The following Table 3 shows a side-by-side comparison between the method of U.S. Pat. No. 6,057,135 and the method of the instant invention.

TABLE 3

Comparison of Instant Method to Conventional Processing

| Process | U.S. Pat. No. 6,057,135 method | Instant method |
|---|---|---|
| 1. Lactose Hydrolysis | | |
| Yield | 80-90% | 95% |
| Temperature | 40-60 C. | 60-70 C. |
| pH | 4 to 6 | 2 |
| Starting material | Lactose Permeate: 2 to 6 wt % lactose | deprotenized whey: 75 to 80 wt % lactose |
| 2. desalination | Required | Not required |
| 3. Evaporation | Required | Not required |
| 4. Filtration | Required | Not required |
| 5. Fermentation (Glucose to Ethanol) | Required | N/A |
| Ethanol distillation | Required | N/A |
| Glycerol formation | Yes | N/A |
| 6. Isomerization | Enzymatic (L-Arabinose) | Chemical ISOM |
| Temp | 50-70 C. | 16 C. |
| pH | 5.5-7 | >11.5 |
| % conversion | 25-35% | 74% or more |
| % tagatose yield | 20-45% | 97% |
| 7. Filtration, desalination | Required | Required |
| 8. Isolation/Purification | Batch mode | SMB |
| Products | Low purity Tagatose and low purity Galactose | Extract: 95% Tagatose Raffinate: 80% Glucose |

TABLE 3-continued

| Comparison of Instant Method to Conventional Processing | | |
|---|---|---|
| Process | U.S. Pat. No. 6,057,135 method | Instant method |
| Tagatose Purity | 70-80% | >95% |
| Recoveries | 40-50% | >90% |
| 9. Tagatose Crystallization | | |
| Yield | 40-50% | >80-90% |
| Ethanol addition | Required | Not required |

In summary, the following conclusions can be drawn from this comparison:

A. The conventional production of tagatose from lactose (whey) as disclosed in the U.S. Pat. No. 6,057,135 wherein the lactose is hydrolyzed to glucose and galactose by enzymatic conversion, requires significant filtration efforts to remove biomass, whereas acid induced chemical conversion process of the present invention, postpones the filtration stage until the separation step after the isomerization step and before the SMB separation.

B. The use of $H_2SO_4$ acid (sulfuric) results in the present invention in the formation of $CaSO_4$ salts which have a very low solubility in sugar solution and are thus precipitated out easily (easy to filter), compared to use of HCl acid which forms $CaCl_2$ salts, that are completely soluble in water and require an expensive ion exchange stage to isolate.

C. $CaSO_4$ in the present invention provides excess surface area and acts to catalyze the formation of tagatose in significantly less time, compared to previous process in which no $CaSO_4$ is involved.

D. The instant process provides further benefits over the traditional process where glucose is converted to ethanol and distilled off with about 5-10% glycerol remaining in sugar solution, thus reducing the tagatose crystallization yield significantly. The instant eliminates conversion of glucose to ethanol and thereby avoids the formation of any glycerol. Furthermore, the instant invention eliminates the distillation of ethanol and the associated operating and capital costs of distillation. Without the glycerol in the sugar solution the tagatose crystallization results in a significantly higher tagatose crystallization yield.

Glucose-Tagatose SMB resin is more selective as compared to Galactose-Tagatose chromatographic separation and therefore higher throughputs can be achieved. The raffinate stream is high % d-glucose syrup which has better commercial value.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

I claim:

1. A process for the production of high purity d-tagatose and high purity d-glucose from a condensed deproteinized whey stream, said process comprising:

a. passing the condensed deproteinized whey stream to a hydrolysis zone and therein admixing the condensed deproteinized whey stream with a dilute sulfuric acid stream to provide a dilute deproteinized whey stream and therein hydrolyzing at effective hydrolysis conditions at least a portion of the deproteinized whey stream in the presence of an effective amount of sulfuric acid to provide a hydrolysate stream comprising d-galactose, d-glucose, unconverted lactose, water, sulfuric acid and salts;

b. passing the hydrolysate stream to a first neutralization zone and therein contacting the hydrolysate stream with an effective amount of calcium hydroxide to provide an unfiltered neutralized hydrolysate stream comprising d-galactose, d-glucose, unconverted lactose, water and salts;

c. passing the unfiltered neutralized hydrolysate stream comprising d-galactose, d-glucose, unconverted lactose, water and salts to an isomerization zone at an effective isomerization temperature in the presence of an effective amount of calcium oxide and calcium chloride to isomerize at least a portion of the d-galactose to d-tagatose and d-glucose to provide an isomerate stream comprising d-galactose, d-glucose, lactose, d-tagatose, water, and salts;

d. passing the isomerate stream to a second neutralization zone and therein contacting the isomerate stream with an effective amount of sulfuric acid to neutralize the isomerate stream and provide a neutralized isomerate stream having a pH of between about 6 and about 7;

e. passing the neutralized isomerate stream to a filtration zone having a filter size effective to remove at least a portion of the salts to provide a filtered isomerate stream essentially free of salts comprising d-galactose, d-glucose, lactose, d-tagatose, and water;

f. passing the filtered isomerate stream and a mobile phase desorption stream comprising water continuously to a continuous simulated moving bed (SMB) zone containing a plurality of adsorbent beds comprising a stationary phase agent consisting of a strong acid cation exchange resin having a calcium cation to continuously provide an extract stream comprising substantially pure d-tagatose, water, and a minor portion of d-galactose, a primary raffinate stream comprising water, d-galactose, and d-glucose, and a secondary raffinate stream consisting essentially of water;

g. passing the extract stream to a first evaporization zone to remove at least a portion of the water to provide an evaporated extract stream;

h. passing the evaporated extract stream to a crystallizer zone to provide a high purity d-tagatose stream in the form of a powder or crystals;

i. passing the primary raffinate stream to a second evaporator to provide an enriched d-glucose syrup; and j. returning at least a portion of the secondary raffinate to step (f) to provide at least a portion of the mobile phase desorbent stream.

2. The process of claim 1, wherein the diluted deproteinized whey stream comprises from about 10 to about 30 wt-% lactose.

3. The process of claim 1, wherein the diluted deproteinized whey stream comprises from about 25 to about 30 wt-% lactose.

4. The process of claim 1, wherein the effective amount of sulfuric acid in the hydrolysis zone comprises, on a dry weight basis, a lactose to sulfuric acid ratio of about 2.1:1 or 2:1.1.

5. The process of claim 1, wherein the effective amount of calcium hydroxide to neutralize the hydrolysate stream comprises an amount equivalent to about 80 to about 90 mol-% of the effective amount of sulfuric acid.

6. The process of claim 1, wherein the effective hydrolysis conditions include a hydrolysis temperature of from 40 to about 80° C.

7. The process of claim 1, wherein the effective hydrolysis conditions include a hydrolysis temperature of from 70 to about 80° C.

8. The process of claim 1, wherein the effective hydrolysis conditions include a pH ranging from about 1 to about 3.

9. The process of claim 1, wherein the extract stream comprising substantially pure d-tagatose comprises from 90 to 99 wt-% tagatose based on total sugar mass in the extract stream.

10. The process of claim 1, wherein the enriched glucose syrup comprises from about 75 to about 80 wt-% glucose, based on total sugar mass in the enriched glucose syrup.

11. The process of claim 1, wherein the continuous SMB zone comprises a 2-3-2-1 SMB cycle wherein at least 2 adsorbent beds undergo desorption, at least 3 adsorbent beds undergo rectification, and at least 2 adsorbent beds undergo adsorption, and at least one adsorbent bed undergoes regeneration and recovery of mobile phase desorbent during said SMB cycle.

12. The process of claim 1, wherein the continuous SMB zone comprises at least 8 adsorbent beds containing a stationary phase adsorbent consisting of a strong acid calcium cation exchange resin.

13. The process of claim 1, wherein the strong acid calcium exchanged resin has a particle diameter of between about 190 and about 330 microns.

14. The process of claim 1, wherein the strong acid calcium exchanged resin has a particle diameter of between about 190 and about 250 microns.

15. The process of claim 1, wherein the effective isomerization temperature comprises between about 12 and about 16° C.

16. The process of claim 1, wherein the dilute sulfuric acid comprises a sulfuric acid concentration of from about 10 to about 12 wt-% of the sulfuric acid in deionized water.

17. The process of claim 1, wherein the filtration zone comprises a filter size effective to remove at least a portion of the salts and having a filter size of less than or equal to 0.45 microns.

* * * * *